US005622309A

United States Patent [19]

Matsuda et al.

[11] Patent Number: 5,622,309

[45] Date of Patent: Apr. 22, 1997

[54] CARTON FOR PACKAGING CUT SHEETS OF PAPER

[75] Inventors: Junko Matsuda; Kazuhide Suzuki; Haruo Muramatsu; Taiji Ohashi, all of Tokyo, Japan

[73] Assignee: Fuji Xerox Office Supply Co., Ltd., Tokyo, Japan

[21] Appl. No.: 526,693

[22] Filed: Sep. 11, 1995

[30] Foreign Application Priority Data

Dec. 13, 1994 [JP] Japan ..... 6-308579

[51] Int. Cl.[6] ..... B65D 5/54

[52] U.S. Cl. ..... 229/243; 229/122; 229/237; 229/244

[58] Field of Search ..... 229/122, 230, 229/233, 237, 243, 244

[56] References Cited

U.S. PATENT DOCUMENTS

| | | | |
|---|---|---|---|
| 1,717,367 | 6/1929 | Byrne | 229/233 |
| 3,262,631 | 7/1966 | Belsinger | 229/122 |
| 3,302,857 | 2/1967 | Martin | 229/244 |
| 3,357,542 | 12/1967 | Aquino et al. | 229/230 |
| 3,756,502 | 9/1973 | Swanson et al. | 229/122 |
| 4,396,143 | 8/1983 | Killy | 229/243 |
| 5,505,372 | 4/1996 | Edson et al. | 229/244 |

FOREIGN PATENT DOCUMENTS

| | | | |
|---|---|---|---|
| 2683207 | 5/1993 | France | 229/230 |
| 5032251 | 2/1993 | Japan | 229/243 |
| 2184999 | 7/1987 | United Kingdom | 229/244 |

*Primary Examiner*—Gary E. Elkins
*Attorney, Agent, or Firm*—Rogers & Killeen

[57] ABSTRACT

The disadvantages of conventional carton for packaging cut sheets of paper such as the facts that fingers or finger nails are injured upon opening the carton, tearing requires a large force, the removal of the cut sheets is difficult, the beauty of surroundings is spoiled, movement of the carton is required, and industrial wastes are produced are solved by the present invention. A pair of opening face cut lines such as threaded lines, zipper and the like are formed on two selected faces of the rectangular parellelepiped carton, and a trigger cut line such as a threaded line, zipper and the like is formed on this one face or another face. The trigger cut line is connected to the opening face cut lines. The trigger cut line and the opening face cut lines are torn off after cutting and raising a part of the trigger cut line. The face having the opening face cut lines is used as an opened face.

8 Claims, 7 Drawing Sheets

CARTON FOR PACKAGING CUT SHEETS OF PAPER

FIELD OF THE INVENTION

The present invention relates to a carton for packaging cut sheets of paper, and more particularly to a carton for packaging cut sheets of paper which can readily be opened and can prevent the stain and damage of the cut sheets remaining in the carton after the carton has been opened.

BACKGROUND OF THE INVENTION

The cut sheets of paper such as PPC (Plain Paper Copier) paper, printing paper, thermal paper, thermal transfer paper, non carbon paper, carbon paper, Diazo paper, ink jet printing paper, label stock and the like which are mainly used in an office are packed as one volume unit consisting of 100, 250, 500 or 1000 sheets of paper with a sheet of wrapping paper to form a volume of the cut sheets of paper, and the one to ten volumes of them are packed into corrugated fibreboard box or board, and at times, into resin carton for shipping them.

The conventional cartons formed by corrugated fibreboard or board include a glued face opening type of carton in which the glued flap is peeled off to open the carbon, a cut tape stripping off type of carton in which the cut tape provided on the top panel, side panel, bottom panel and side panel in the vicinity of the opening and of the carton is stripped off to expose the end of the cut sheets of paper and the like.

The conventional glued face opening type of carton has the top panel, right side panel, left side panel, bottom panel, front flap face and rear flap face, where the front flap face has the outer flap and inner flap, the and in which inner flap is adhered to the outer flap, and the glued width provided on the bottom panel is adhered to the right side panel.

This conventional carton is opened by inserting fingers or finger nails into the space between outer flaps of the front flap face, tearing off the outer flaps forward, opening the inner flaps to make the front flap face an open face. Then, the volumes of the cut sheets of paper are drawn out of the carton by inserting fingers into the space between a volume of the cut sheets of paper and the top panel and the space between the volumes or inserting the fingers into the fold portions of the wrapped paper for the volume to take out of the volume.

The conventional cut tape stripping off type of carton has a cut tape provided into the bottom panel, left side panel, top panel and right side panel in the vicinity of the front flap face. This conventional carton is opened by drawing out one end of the cut tape, tearing off the periphery of the carton with the cut tape to make the front flap to an open face so as to expose the end of the volumes of cut sheets of paper.

One example for the size, weight and the like of the conventional carton for packaging cut sheets of paper is as follows.

| size of cut sheet | lateral (mm) | longitudinal (mm) | height (mm) | weight (kg) |
|---|---|---|---|---|
| B5 | 190 | 265 | 230 | 7.5 |
| A4 | 218 | 325 | 230 | 10 |
| B4 | 265 | 373 | 230 | 15 |
| A3 | 306 | 430 | 230 | 20 |

In this way, since the carton for packaging cut sheets of paper has a large weight, it is made by corrugated fibreboard or board by considering the mechanical strength of the carton, and the peel off of glued surface of the flap upon pile up of the cartons is prevented by adhering the flap faces with a high glued strength.

However, according to the conventional glued face opening type of carton, fingers or finger nails have to be inserted into the gap or space between the outer flaps, and thus there is a fear of injuring the fingers or nails. In particular, the bonded strength between the inner and outer flaps is very high and in addition, the area of a handhold to tear off them is small, and thus it required a considerable high force. It is also difficult to take out the volume of cut sheets of paper because there is no handhold to take out the volume of cut sheets of paper. Further the state that the front flap is opened spoils the beauty of surroundings where the carton is placed. In order to prevent this, it is cumbersome to reseal the opened portion of the carton because it requires a separate adhesive tape after bending the inner and outer flaps.

On the other hand, according to the conventional cut tape stripping off type of carton, the cut tape is extended onto the bottom panel of the carton, and thus the carton has to be placed on the surface of a table so that one side of the carton having the cut tape is projected from the edge of the table to strip off the cut tape, or said one side of the carton has to be placed vertically to strip off the cut tape, and thus, the carton must be held up and moved at each time, resulting in a cumbersome work. Once the carton is opened, one end of the respective volumes of cut sheets of paper is exposed and it is impossible to reseal the carton resulting in spoiling the beauty. In addition, the cut off portions of the carton become waste and the portions cut off by a plastic tape form industrial waste.

Accordingly, it is an object of the present invention to provide a carton for packaging cut sheets of paper which can be opened without injuring fingers or finger nails.

It is another object of the present invention to provide a carton for packaging cut sheets of paper which can be opened without a considerable force.

It is another object of the present invention to provide a carton for packaging cut sheets of paper which a volume or volumes of cut sheets of paper can be readily taken out of the inside of the carton.

It is another object of the present invention to provide a carton for packaging cut sheets of paper which can readily be resealed without spoiling the surrounding beauty.

It is another object of the present invention to provide a carton for packaging cut sheets of paper which is no need to hold up and to move the carton for opening it.

It is another object of the present invention to provide a carton for packaging cut sheets of paper which industrial wastes such as plastic tapes and the like are not are not produced upon opening the carton.

SUMMARY OF THE INVENTION

According to the present invention, a rectangular parallelepiped carton for packaging cut sheets of paper is disclosed. The carton for packaging cut sheets of paper which is made by corrugated fibreboard or paper board and is rectangular paralleleppiped, comprises an outer flap on an opening face; an inner flap located inside said outer flap; a pair of cut lines such as threaded lines, zippers and the like formed on the opening face of the carton and along a pair of sides of said inner flap; and a trigger cut line such as threaded line, zipper and the like formed on the face adjacent to said outer flap; wherein said inner flap is bonded to said outer flap only in the inner area of said opening face cut lines; and when a part of said trigger cut line is cut and raised and then the tear off beginning with said trigger cut line followed by said pair of opening face cut lines are carried out to form an opened face, said outer flap is not peeled off from the area inside said pair of opening face cut lines.

Here, a pair of opening face cut lines are formed along a pair of opposite sides. The term "along the side" means that the opening face cut line is formed on the side and at a predetermined distance from the side.

DESCRIPTION OF THE PREFERRED EMBODIMENTS

Before describing a carton for packaging cut sheets of paper in preferred embodiments according to the present invention, the conventional carton for packaging cut sheets of paper described above will be described by reference to the appended drawings, in which like numerals indicate like elements throughout the drawings.

Figure 1:
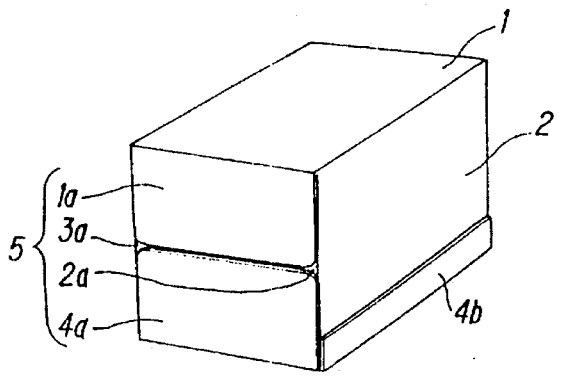
FIG.1 PRIOR ART
FIG. 1 is a perspective view of a conventional carton for packaging cut sheets of paper.
Figure 2:
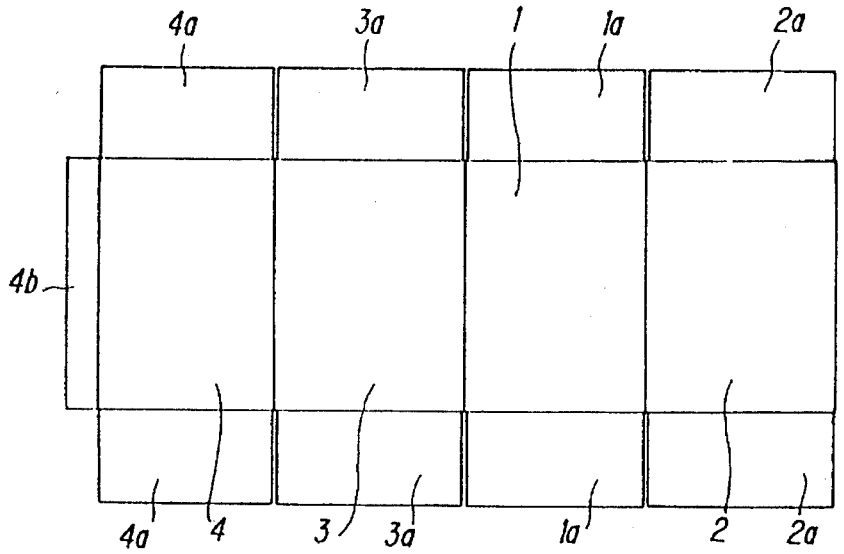
FIG.2 PRIOR ART
FIG. 2 is an unfolded view of the conventional carton for packaging cut sheets of paper shown in FIG. 1.

FIGS. 1 and 2 show a conventional glued surface opening type of carton. This carton has the top panel 1, right side panel 2, left side panel 3, bottom panel 4, front flap 5, and rear flap. The front flap 5 has the outer flaps 1*a* and 4*a*, and the inner flaps 2*a* and 3*a*. The outer flaps 1*a* and 4*a* are adhered to the inner flaps 2*a* and 3*a*, and the overlap width portion 4*b* is adhered to the right side panel 2.

Figure 3:
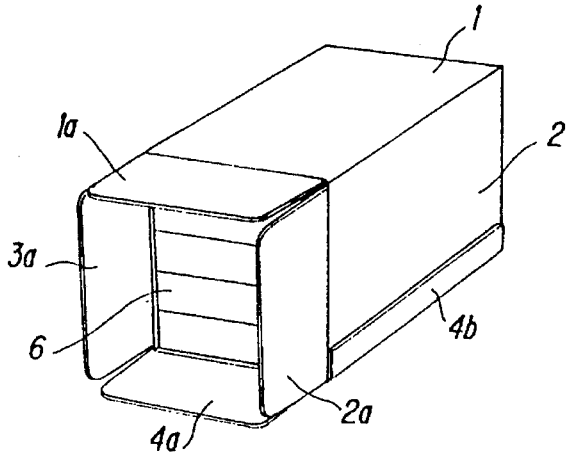
FIG.3 PRIOR ART
FIG. 3 is a perspective view of the conventional carton for packaging cut sheets of paper shown in FIG. 1 showing the opened state of the carton.

The carton shown in FIG. 1 is opened by inserting fingers or finger nails into the space between the outer flaps 1*a*, and 4*a*, then tearing them forward, and opening the inner flaps 2*a* and 3*a* to make the front flap 5 into an opening face as shown in FIG. 3. The volumes 6 of the cut sheets contained in the carton are taken out from the opened face of the carton by inserting fingers into the space between the top surface of the volume 6 and the top panel 1 and the space between the stacked volumes 6 or inserting fingers and the like into the folded down portions of wrapped paper to take out the volumes 6 of the cut sheets of paper.

Figure 4:
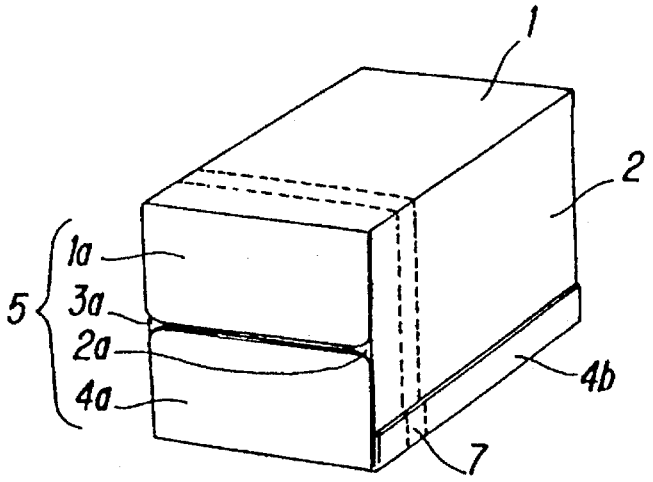
FIG. 4 PRIOR ART
FIG. 4 is a perspective view of another conventional carton for packaging cut sheets of paper.
Figure 5:
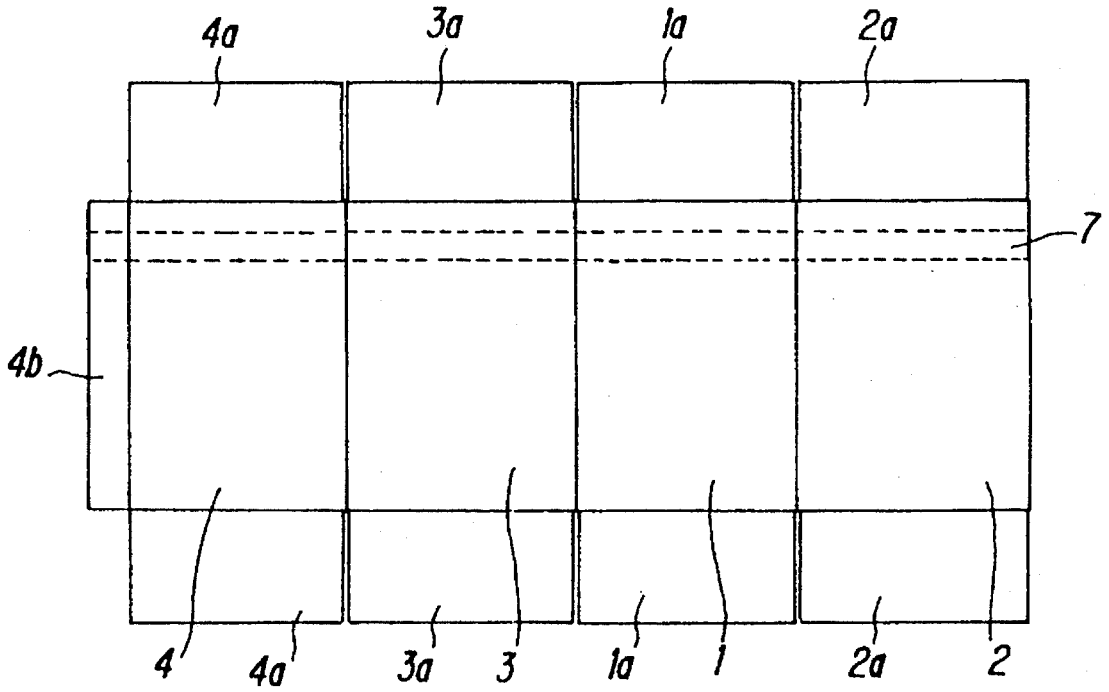
FIG. 5 PRIOR ART
FIG. 5 is an unfolded view of the conventional carton for packaging cut sheets of paper shown in FIG. 4.

FIGS. 4 and 5 show a conventional cut tape stripping off type of carton, in which like numerals indicate like elements through the glued surface opening type of carton shown in FIGS. 1 and 2, and thus repeated description is omitted. In this conventional cut tape stripping off type of carton, a cut tape 7 is provided on the bottom panel 4, left side panel 3 and right side panel 2 in the vicinity of the front panel 5.

Figure 6:
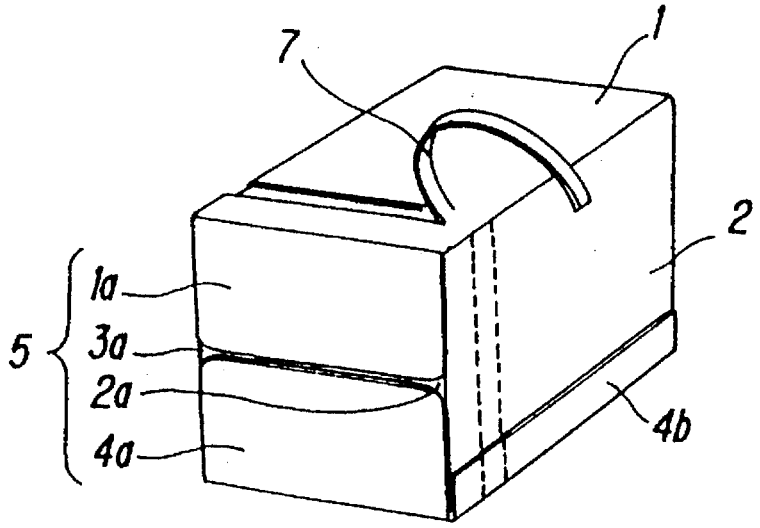
FIG. 6 PRIOR ART
FIG. 6 is a perspective view of the conventional carton for packaging cut sheets of paper shown in FIG. 4 showing the operation to open the carton.
Figure 7:
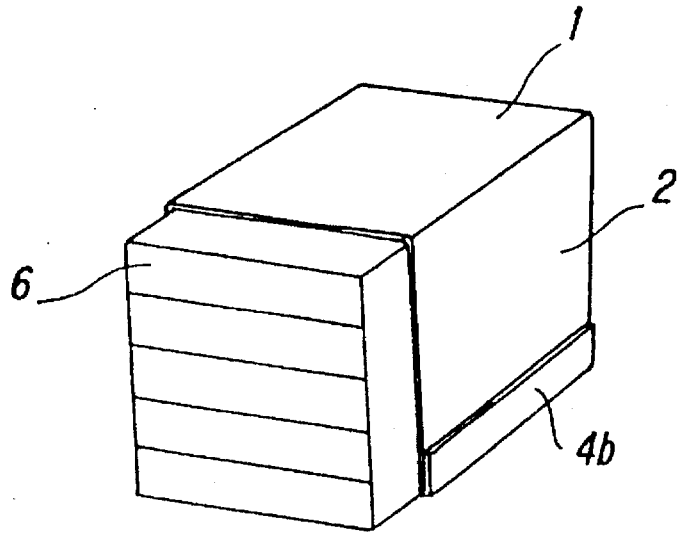
FIG. 7 PRIOR ART
FIG. 7 is a perspective view of the conventional carton for packaging cut sheets of paper shown in FIG. 4 showing the opened state of the carton.

The carton shown in FIG. 4 is opened by taking out one end of the cut tape 7 as shown in FIG. 6, cutting off the periphery of the carton with the cut tape 7, making the front flap 5 into an opened face to expose the ends of the volumes 6 of cut sheets of paper as shown in FIG. 7.

Next, referring to the drawings, cartons for packaging cut sheets of paper according to the present invention will be described hereinafter.

Figure 8:
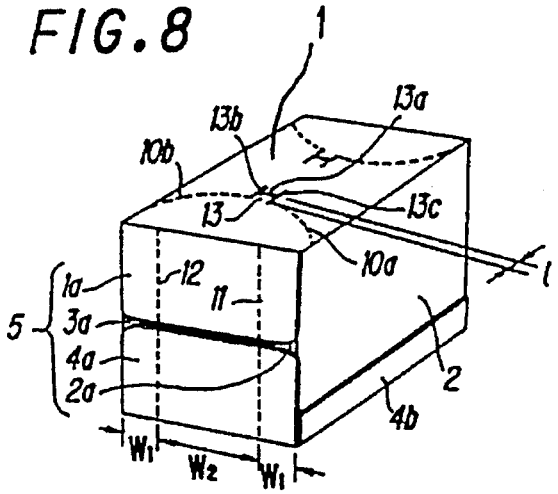
FIG. 8 is a perspective view of a first preferred embodiment of a carton for packaging cut sheets of paper of the present invention.
Figure 9:
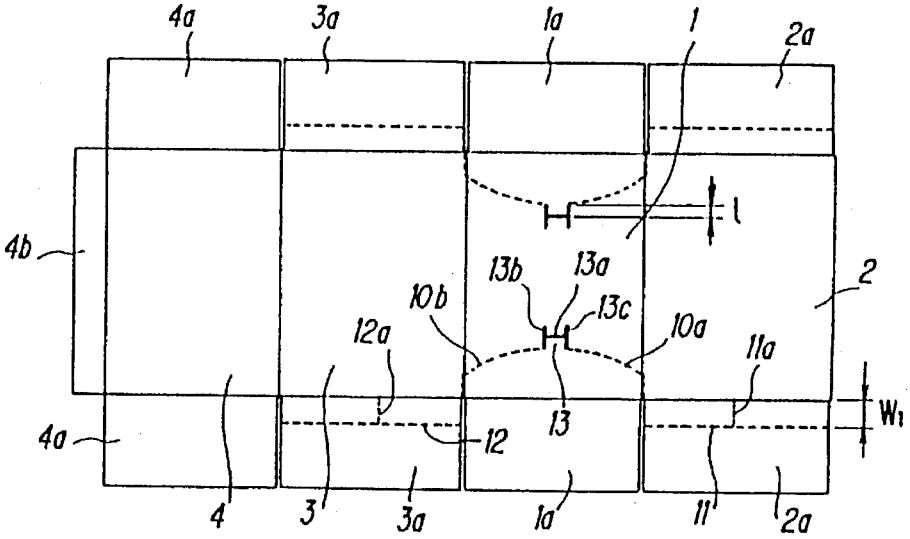
FIG. 9 is an unfolded view of the carton for packaging cut sheets of paper of the present invention shown in FIG. 8.

FIGS. 8 and 9 show a carton for packaging cut sheets of paper in a first preferred embodiment of the present invention, in which like numerals indicate like elements throughout FIGS. 1–10 and thus repeated description is omitted. In this carton, the top panel 1 has a pair of trigger cut lines 10*a* and 10*b* formed by threaded lines, and the inner flaps 2*a* and 3*a* are integrated with the side panels 2 and 3. respectively, and have a pair of opening face cut lines 11 and 12 formed by threaded lines. The pair of trigger cut lines 10*a* and 10*b* are connected to the pair of opening face cut lines 11 and 12 and a tongue 13 on the top thereof. The tongue 13 is formed by providing cuts 13*a*, 13*b* and 13*c* therearound, and preferably, it has a length L ranging from 10 to 40 mm. The cut lines 11 and 12 formed in the inner flaps 2*a* and 3*a*, respectively are located at a distance $W_1$ from each of the opposite sides of the side panels 2 and 3. In FIG. 8, the inner flaps 2*a* and 3*a* are not glued to the outer flaps 1*a* and 4*a* in the area of the distance $W_1$, but the formers are glued to the latters in the area of the distance $W_2$ with an enough mechanical strength not to be peeled off upon the shipping, storage and even opening of the carton. Considering the mechanical strength after opening the carton, the value of $W_1$ is preferable in the range of 20 to 50 mm. Further, the inner flaps 2*a* and 3*a* have horizontal perforated cut lines 11*a* and 12*a*, respectively.

In operation, the pair of trigger cut lines 10*a* and 10*b* formed in the top panel 1 are torn off by inserting fingers into the cut 13*a* of the tongue 13 to pull the tongue 13 forward. When this pair of trigger cut lines 10*a* and 10*b* reach to the pair of cut lines 11 and 12 of the opening face 5, respectively, the inner flaps 2*a* 3*a* can be torn off along the cut lines 11 and 12, respectively, and the area of $W_1$ in the inner flaps 2*a* and 3*a* remain in the side panels 2 and 3, respectively and the area of $W_2$ glued on the outer flaps 1*a* and 4*a* falls forward from the front flap face 5 to provide an opened face as shown in FIG. 10.

Figure 10:
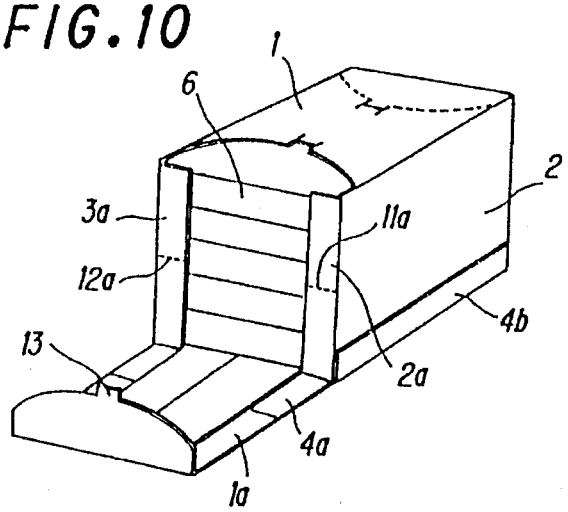
FIG. 10 is a perspective view of the first preferred embodiment of the carton for packaging cut sheets of paper of the present invention shown in FIG. 8 showing the opened state of the carton.

In the first preferred embodiment shown in FIGS. 8–10, a pair of trigger cut lines 10*a* and 10*b* are formed in front of and in the rear of the top panel 1 so that the front and rear flaps faces 5 become an opening face, and a pair of opening face cut lines 11 and 12 are formed in front of and in the rear of both side panels 2 and 3. However, their trigger cut lines and opening face cut lines may be formed on either one of the front and rear flaps.

Figure 11:
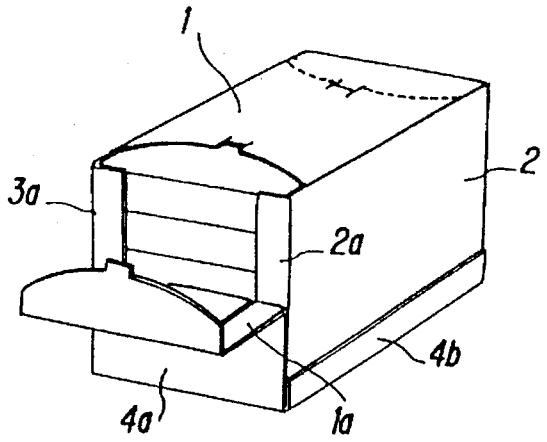
FIG. 11 is a perspective view of the first preferred embodiment of the carton for packaging cut sheets of paper of the present invention showing another opened state of the carton.

FIG. 11 shows the variation of the first preferred embodiment described above wherein the tear off of the front flap 5 is stopped at the interface between the outer flaps 1*a* and 4*a*, where the inner flaps 2*a* and 3*a* are bent forward. In this manner, the opened area of the front flap 5 can be halved, and thus the dust influence can be reduced by half. At this time, the horizontal cut lines 11*a* and 12*a* are torn off to facilitate the taking out of the volumes 6 of the cut sheets. Even in any opened state of the front flap 5 shown in FIGS. 10 and 11, a certain measure of sealed state can be obtained by putting the tongue 13 back to the original position of the top panel 1 and making it to engage with the cut lines 10*a* and 10*b*, and the cuts 13*a*–13*c*. In the situation where a space is formed within the carton by use of at least one volumes of the cut sheets, the trigger face joined with the portions of the inner and outer flaps which are separated by the cut lines 11 and 12 and are glued, can be made fast to the W1 portion of the inner flaps 2*a* and 3*a* (these are referred to as "reseal" hereinafter). In the case where the tongue 13 is put back to the original position of the top panel 1, the dust influence can be more reduced resulting in an improved seal by attaching the tongue 13 to the the top panel 1 by an adhesive tape.

Figures 12A, 12B, 12C:
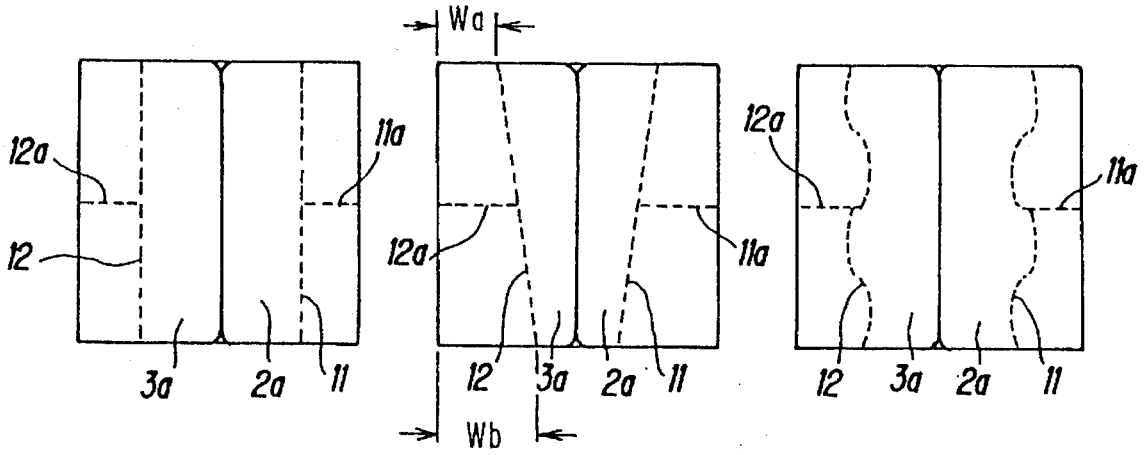
FIGS. 12A–12C show other flaps in the first preferred embodiment of the carton for packaging cut sheets of paper of the present invention, respectively.

FIGS. 12A, 12B and 12C show a pair of cut lines 11 and 12 formed in the inner flaps 2*a* and 3*a*, respectively. FIG. 12A shows the inner flaps 2*a* and 3*a* having a pair of cut lines 11*a* and 12*a* perpendicularly intersecting the horizontally extending cut lines 11 and 12, respectively, thereby facilitating the take out of the volumes of cut sheets of paper by tearing off the cut lines 11*a* and 12*a* even in the situation shown in FIG. 11. FIG. 12B shows the inner flaps 2*a* and 3*a* having a pair of inclined cut lines 11 and 12. This provides an incorporated portion longer by the amount corresponding to the inclined angle when the front flap is put back to the original position after opening the carton, resulting in a stable sealed state. In addition, the torn portion of the front flap tends to converge inwardly, so that the shape of this cut line meets its tendency. Preferably, the cut lines 11 and 12 are formed at a position having distances $W_a$ and $W_b$ in the range of 0–50 mm and more preferably 0–40 mm from the longitudinal edge of the inner flaps 2*a* and 3*a*, respectively. FIG. 12C shows the inner flaps 2*a* and 3*a* having a pair of curved cut lines 11 and 12 formed thereon, thereby still more enhancing the effect described in FIG. 12B.

In the first preferred embodiment described above, the tongue 13 is formed at the top of the pair of trigger cut lines 10*a* and 10*b*. However, a notch which is provided instead of the tongue 13 to make the take out of the trigger end liable may have similar effects.

Figure 13B:
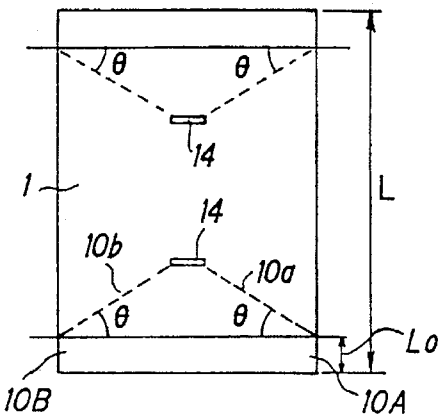
FIG. 13B shows an angle forming trigger cut lines in the second preferred embodiment of the carton for packaging cut sheets of paper shown in FIG. 13A.
Figure 13C:
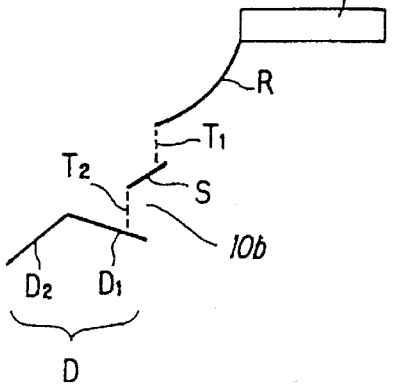
FIG. 13C shows a trigger cut line in the second preferred embodiment of the carton for packaging cut sheets of paper shown in FIG. 13A.
Figure 13A:
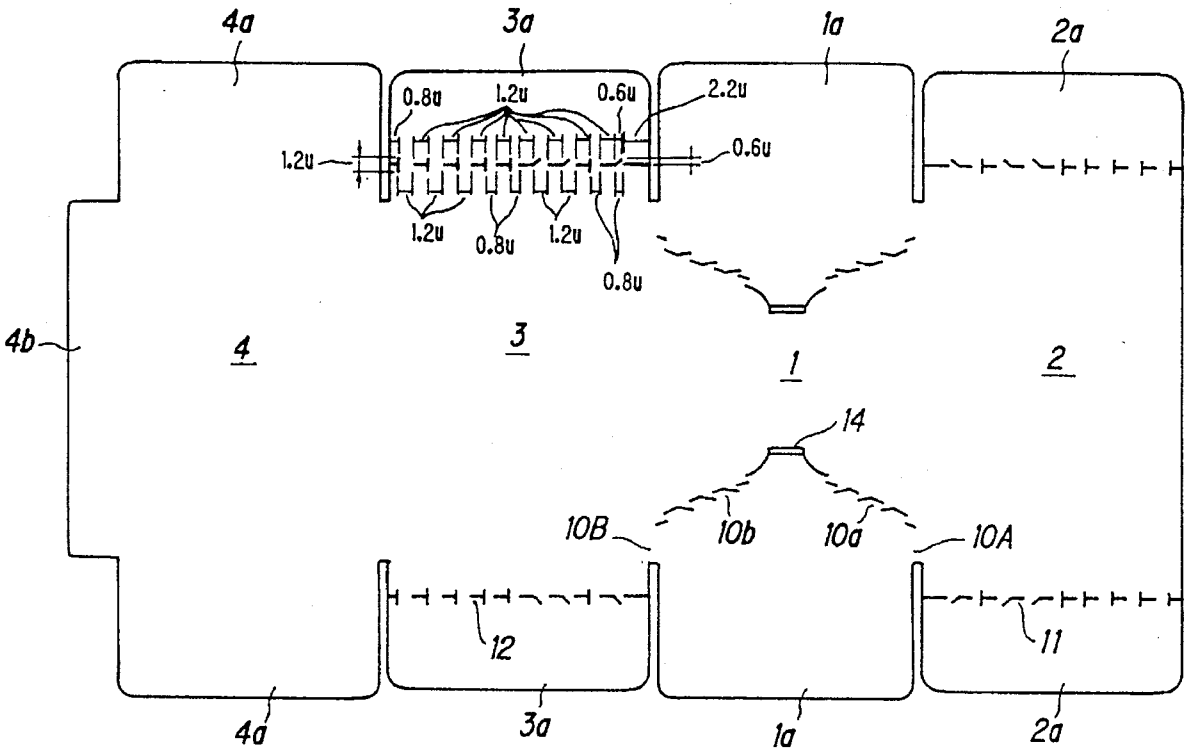
FIG. 13A is an unfolded view of a second preferred embodiment of a carton for packaging cut sheets of paper according to the present invention.

FIGS. 13A, 13B and 13C show a carton for packaging cut sheets of paper in a second preferred embodiment of the present invention, in which like numerals indicate like elements throughout the first and second preferred embodiments, and thus repeated description will be omitted. In these drawings, a pair of trigger cut lines 10*a* and 10*b*, and a pair of opening face cut lines 11 and 12 are shown characteristically. A pair of trigger cut lines 10*a* and 10*b* are formed on a top panel 1, and they are connected at the top by a slit-like notch 14 to facilitate the cutting and raising thereof. As shown in FIG. 13C, the notch 14 is followed by a curved cut line R, a non-cut portion $T_1$, a straight cut line S, a non-cut portion $T_2$, and a polygonal line D having a tear-receiving portion $D_1$ and a tear-transmitting portion $D_2$. As shown in FIG. 13A, the lowermost cut lines or portions reach to the sides of top panel 1, leaving the non-cut portions 10A and 10B. On the other hand, the pair of opening face cut lines 11 and 12 are formed on the inner flaps 2*a* and 3*a* and have a predetermined distance inside from the corresponding side pair, and except for the uppermost straight cut lines, the polygonal lines and T-type cut lines including the tear-receiving portion and the tear-transmitting portion are formed thereon. This pair of opening face cut lines 11 and 12 have non-cut portions arranged at regular intervals and have the dimensions indicated in FIG. 13A, in consideration of the unopened mechanical strength and the tear off characteristics while the carton is being opened. In FIG. 13A "u" is one unit of length and, for example, 1.2 u represents the length of twice 0.6 u. FIG. 13B shows the angle that a pair of trigger cut lines 10*a* and 10*b* are formed on the top panel 1, and it has experimentally been proved that the optimum value of θ is: $25' < \theta < 40'$. When θ is less than 25', the mountain-like shape formed by the top of the pair of the trigger cut lines 10*a* and 10*b* become flat and the tear may be produced at the sites other than the cut lines 10*a* and 10*b*, and when θ is not less than 40', the total length of the cut lines 10*a* and 10*b* become larger and it was confirmed that its mechanical strength was reduced. As shown in FIG. 13B, it was found desirable that the relation between the distance $L_o$ from the side facing the notch 14 and the longer side L of the top panel 1 meets the following inequlity: $\frac{1}{5} < L_o < \frac{2}{5}$ L. When $L_o$ is less than ⅕ L, the tear off becomes difficult, and when $L_o$ is more than ⅖ L, the mechanical strength is reduced. When the trigger cut lines 10*a* and 10*b* are torn off upon opening the carton by inserting fingers into the notch 14, the torn lines are transferred from the curved cut lines R through the non-cut portions $T_1$ to the straight-like cut lines S, and then from the cut lines through the non-cut portions $T_2$ to the tear receiving portions $D_1$ of the polygonal line-like cut portions D. Similarly, the transfer of the tear off is effected for the opening face cut lines 11 and 12. As the shape shown in FIG. 12B, the tear off on the opening face tends to converge inwardly. Therefore, as shown in FIG. 13A, the cut portions have the polygonal lines or T-type lines to receive the inwardly converging tear off. In this second preferred embodiment, the inner flaps 2*a* and 3*a* are also glued to the outer flaps 1*a* and 4*a* in the inside of a pair of the opening face cut lines 11 and 12 with a non-peel off bonding strength.

Figure 14:
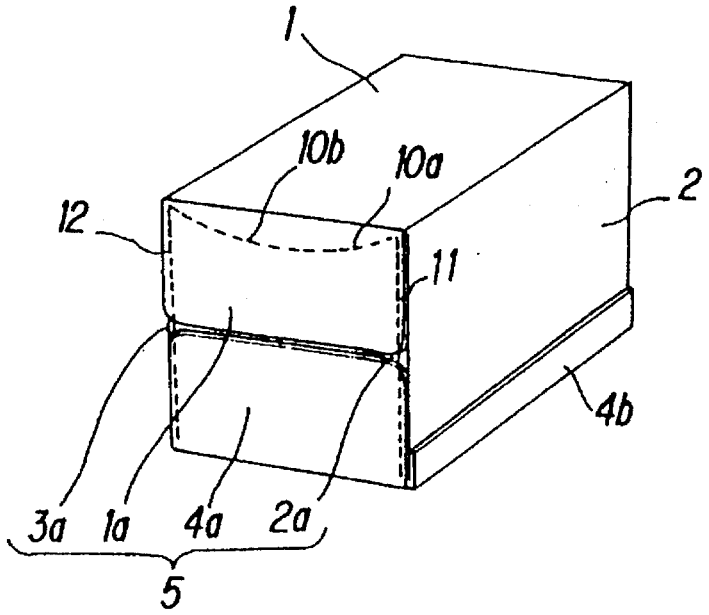
FIG. 14 is a perspective view of a third preferred embodiment of a carton for packaging cut sheets of paper of the present invention.

FIGS. 14 shows a carton for packaging cut sheets of paper in a third preferred embodiment of the present invention, in which like numerals indicate like elements throughout the first, second and third preferred embodiments, and thus repeated description will be omitted. This third preferred embodiment differs from the first preferred embodiment in the respect that a pair of trigger cut lines 10*a* and 10*b* are formed on the outer flap 1*a* of the front flap 5, and a pair of opening face cut lines 11 and 12 are formed very closely to the sides of the inner flaps 2*a* and 3*a* ($W_1$ is about "0").

Although the tongue or notch described above is provided at the combined point of a pair of the trigger cut lines 10*a* and 10*b*, it is omitted for clarity in FIG. 14. The inner flaps 2*a* and 3*a* are bonded to the outer flaps 1*a* and 4*a* in the portion lower than the trigger cut lines 10*a* and 10*b* and in the inner portions of the opening face cut lines 11 and 12, and they have a bonding strength which is not peeled off upon opening the carton.

In operation, the pair of trigger cut lines 10*a* and 10*b* are cut and raised from the combined point, and then the pair of opening cut lines 11 and 12 are torn off and thus the portion surrounded by the cut lines 10*a*, 10*b*, 11 and 12 of the inner and outer flaps 2*a*, 3*a*, 1*a* and 4*a* is opened to provide an opened face. When the portion of the outer flap 1*a* higher than the cut lines 10*a* and 10*b* is bent upwardly, the opened face to take out of the volumes of cut sheets of paper is formed. At this time, the take cut of the volumes of cut sheets of paper is further facilitated because the above mentioned $W_1$ is about "0".

Figure 15:
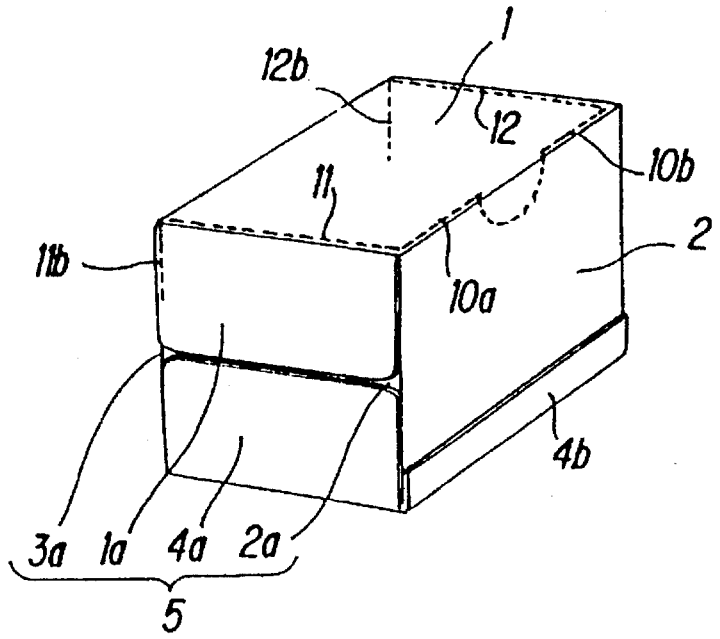
FIG. 15 is a perspective view of a fourth preferred embodiment of a carton for packaging cut sheets of paper of the present invention.

FIGS. 15 shows a carton for packaging cut sheets of paper in a fourth preferred embodiment of the present invention, in which like numerals indicate like elements throughout the first-fourth preferred embodiments, and thus repeated description will be omitted. This fourth preferred embodiment differs from the first-third preferred embodiments in the point that both a pair of trigger cut lines 10*a* and 10*b* and a pair of opening face cut lines 11 and 12 are formed on the top panel 1.

In this fourth preferred embodiment, the combined point of the pair of trigger cut lines 10*a* and 10*b* is located in the upper portion of the right panel 2 and the pair of opening face cut lines 11 and 12 are substantially extended to the middle of the left side panel facing the right side panel 2 as a pair of cut lines 11*b* and 12*b*, respectively.

In operation of the fourth preferred embodiment, the top face 1 is opened when the combined point of the pair of trigger cut lines 10*a* and 10*b* is cut and raised, the trigger cut lines 10*a* and 10*b* are torn off, and then the pair of opening face cut lines 11, 12 are torn off to the cut lines 11*b* and 12*b*. In this case, it is not necessary to take out the volumes of cut sheets of paper by sliding them, but they can be taken out from the carton only by raising them. In addition, since the cut lines 11*a* and 12*b* are extended to the middle of the left side panel, the raise up of the volumes of cut sheets of paper can very simply be effected.

As described above, the carton for packaging cut sheets of paper according to the present invention has the following effects:

(1) Since a pair of trigger cut lines are provided, the carton can readily be opened without hurting fingers or nails, and it can simply be opened oven by women without so much force;

(2) Since at least one face of the rectangular parallelepiped carton can be used as an opening face, the volumes of cut sheets of paper can readily be taken out of the carton;

(3) Since the tear-cut lines or breaks can be engaged each other and can be joined to the remainder of the inner flap;

(4) The opened face can be resealed or closed and thus, it does not spoil the beauty of surroundings; and (5) The selected one face of the rectangular parallelepiped carton can be used as an opening face and thus the opening work of the carton can easily be effected without the raise up or movement of the carton.

The preferred embodiments of the present invention have been disclosed by way of examples and it will be understood that other modifications and variations may occur to those skilled in the art without departing from the scope and the spirit of the appended claims.

What is claimed is:

1. A carton for packaging cut sheets of paper which is a rectangular parallelepiped, comprising, an outer flap on an opening face;

an inner flap located inside said outer flap;

a pair of opening face cut lines along a pair of opposite sides of said inner flap;

a trigger cut line on a face of the carton adjacent to said outer flap;

wherein said inner flap is bonded to said outer flap only in an area between said pair of opening face cut lines so that when a part of said trigger cut line is torn it is followed by tearing of said pair of opening face cut lines to form an opened face, and so that said outer flap is not peeled off from the area between said pair of opening face cut lines.

2. The carton for packaging cut sheets of paper as defined in claim 1, wherein said trigger cut line has one of a tongue and a notch to facilitate tearing said part of said trigger line.

3. The carton for packaging cut sheets of paper as defined in claim 1, wherein said pair of opening face cut line is formed at a predetermined distance inside said pair of opposite sides.

4. The carton for packaging cut sheets of paper as defined in claim 1, wherein said trigger cut line and said pair of opening face cut lines have plural cut portions, said plural cut portions having plural non-cut portions arranged thereamong at predetermined intervals.

5. The carton for packaging cut sheets of paper as defined in claim 4, wherein said cut portions have tear off receiving portions to receive the tear from said non-cut portions and tear off transfer portions to transfer the tear to said non-cut portions.

6. The carton for packaging cut sheets of paper as defined in claim 1, wherein said outer flap, said inner flap and said face adjacent to said outer flap comprise one of corrugated fiberboard and paper board.

7. The carton for packaging cut sheets of paper as defined in claim 1, wherein said pair of opening face cut lines and said trigger cut line comprise one of a threaded line and a zipper.

8. The carton for packaging cut sheets of paper as defined in claim 1, wherein said pair of opening face cut lines and said trigger cut lines comprise a combination of a threaded line and a zipper.

* * * * *